US006862825B1

(12) United States Patent
Lowndes

(10) Patent No.: US 6,862,825 B1
(45) Date of Patent: Mar. 8, 2005

(54) MOUNTING OF FLEXIBLE DISPLAY PANELS

(75) Inventor: James George Lowndes, Constantia (ZA)

(73) Assignee: Omnigraphics Capital (Pty) Limited, Ottery (ZA)

( * ) Notice: Subject to any disclaimer, the term of this patent is extended or adjusted under 35 U.S.C. 154(b) by 73 days.

(21) Appl. No.: 10/129,296

(22) PCT Filed: Oct. 12, 2000

(86) PCT No.: PCT/ZA00/00188

§ 371 (c)(1),
(2), (4) Date: Jul. 15, 2002

(87) PCT Pub. No.: WO01/35382

PCT Pub. Date: May 17, 2001

(30) Foreign Application Priority Data

Nov. 9, 1999 (ZA) ..... 99/7002

(51) Int. Cl.[7] ..... G09F 17/00
(52) U.S. Cl. ..... 40/603; 40/795
(58) Field of Search ..... 40/603, 792, 793, 40/795, 796

(56) References Cited

U.S. PATENT DOCUMENTS 2,979,842 A * 4/1961 DeRidder ..... 40/793 X
5,040,586 A * 8/1991 Hillstrom ..... 40/603 X
5,265,362 A * 11/1993 Yamaguchi ..... 40/603
5,396,722 A * 3/1995 Ostrovsky ..... 40/796
5,555,659 A 9/1996 Hade ..... 40/604
5,735,069 A * 4/1998 Gearing ..... 40/793
5,893,227 A 4/1999 Johansson et al. ..... 40/603
6,233,859 B1 * 5/2001 Kilpatrick et al. ..... 40/796 X

FOREIGN PATENT DOCUMENTS

DE 2447185 4/1976
WO 9312514 6/1993

OTHER PUBLICATIONS

English Comment on DE 2447185 Dated Apr. 8, 1976.

* cited by examiner

*Primary Examiner*—Joanne Silbermann
(74) *Attorney, Agent, or Firm*—Ladas & Parry LLP

(57) ABSTRACT

A mounting structure for a display panel (156) is disclosed. The mounting structure comprises upper and lower fixed extrusions (110), an upper panel mounting extrusion (152) to which the upper edge of the display panel (156) is secured and a lower mounting extrusion (122) to which the lower edge of the display panel (156) is secured. The upper mounting extrusion (152) includes a series of ribs (154.1, 154.2, 154.3) which engage with a recess (120) in the up per fixed extrusion (110). A locking extrusion (138) includes a pivot plate (150) which engages in the recess (120) of the lower fixed extrusion (110). It also has a formation (148) which engages in a socket (124) of the extrusion (122). The panel (156) is tensioned and secured by swinging the extrusion (138) downwardly about its line of contact with the lower extrusion (110). Unlocking is achieved by swinging the extrusion (138) in the opposite direction.

6 Claims, 10 Drawing Sheets

MOUNTING OF FLEXIBLE DISPLAY PANELS

FIELD OF THE INVENTION

THIS INVENTION relates to the mounting of flexible display panels.

BACKGROUND TO THE INVENTION

Mounting systems are in use and which comprise frames and other mounting structures secured to an underlying surface and to which structures the display panel is releasably secured. The present invention seeks to provide an improved mounting system.

BRIEF DESCRIPTION OF THE INVENTION

According to one aspect of the present invention there is provided a method of mounting a display panel which comprises providing an elongate edge element along each of two opposed edges of the display panel, securing first and second elongate mounting elements to a surface, the mounting elements being spaced apart and parallel to one another, locating one edge element of the display panel with respect to said first mounting element by inserting it into a recess provided therefor thereby to mount one edge of the display panel, inserting the other edge element into a recess provided therefor in a third mounting element, connecting said third mounting element to a locking element having a pivot plate, engaging said pivot plate with a pivot surface of said second mounting element, and swinging said locking element in an arc with respect to said second mounting element so that it passes through a dead centre position to an over centre position thereby mounting said other edge of the display panel and applying a tensioning force to the display panel.

According to a further aspect of the present invention there is provided a method of securing a display panel to first and second mounting elements which are parallel to one another and which are spaced apart, the method comprising locating one edge of the display panel with respect to said first mounting element by inserting it into a recess provided therefor thereby to mount said one edge of the display panel, inserting the other panel edge into a recess provided therefor in a third mounting element, connecting said third mounting element to a locking element having a pivot plate, engaging said pivot plate with a pivot surface of said second mounting element, and swinging said locking element in an arc with respect to said second mounting element so that it passes through a dead, centre position to an over centre position thereby mounting said other panel edge and applying a tensioning forces to the display panel.

According to another aspect of the present invention there is provided a mounting structure for a display panel which comprises first and second mounting elements secured to a surface, the elements being parallel to one another and spaced apart, and the second element having a pivot surface extending along it, a third mounting element including means for releasably attaching an edge of the display panel thereto and which itself serves, in use, releasably to connect the display panel to said first mounting element, a fourth mounting element including means for releasably attaching an opposed edge of the display panel thereto, and a locking element including means for pivotally connecting it to said fourth mounting element and having a pivot edge about which it can be swung in an arc with respect to said pivot surface of said second element from an unlocked position through a dead centre position into an over centre position in which it secures said fourth mounting element with respect to said second mounting element.

Each of said first and second elements preferably comprises a plate which is fastened to said surface, and an inclined web protruding from said plate, there being a recess along the free edge of each web and in that surface thereof which faces away from the plate.

Said locking element can comprise a hook structure for connecting it to said fourth mounting element and a plate extending away from said hook structure, said pivot edge being constituted by the edge of said plate remote from the hook structure. Similarly, said fourth mounting element can include a hook structure which can be inter-engaged with the hook structure of the locking element.

To assist in tensioning the display panel, said third element and said fourth element both include plates which have elongate edges that in use bear on the display panel.

According to a further aspect of the present invention there is provided a mounting for one edge of a flexible display panel, the mounting comprising a first elongate element secured to a surface, a second elongate element having surfaces defining a recess into which one stiffened edge of the display panel can be inserted and further surfaces defining a hook structure, a third elongate element having surfaces defining a hook structure which can be releasably inter-engaged with the hook structure of the second element, pivot surfaces on the first and third elements permitting the third element, when said surfaces are in contact to be swung through an arc from a first, unlocked position through a dead centre position and into an overcentre locked position and vice versa, said second element being pulled in the direction which applies a tensioning force to a display panel attached thereto whilst said third element is moving from said unlocked position towards said dead centre position.

BRIEF DESCRIPTION OF THE DRAWINGS

For a better understanding of the present invention, and to show how the same may be carried into effect, reference will now be made, by way of example, to the accompanying drawings in which:—

DETAILED DESCRIPTION OF THE DRAWINGS

Figure 1:
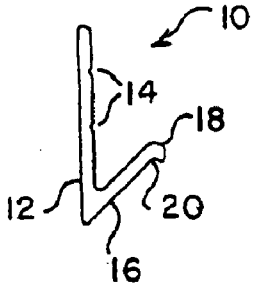
FIGS. 1, 2, 3 and 4 are sections through four extrusions which together constitute a display panel mounting system.
Figure 5:
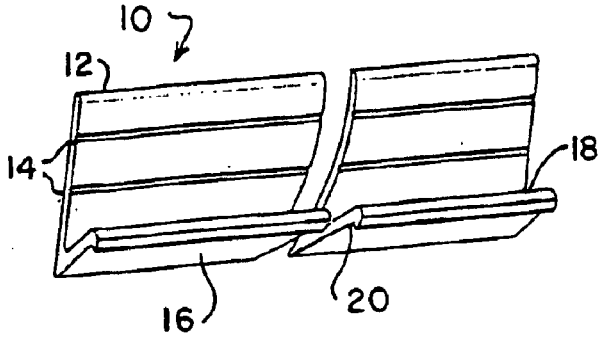
FIGS. 5, 6, 7 and 8 are pictorial views of the extrusions of FIGS. 1 to 4.

The extrusion 10 shown in FIGS. 1 and 5 comprises an elongate main plate 12 which has parallel grooves 14 running along the length thereof. The grooves 14 facilitate the driving of fasteners such as pop rivets through the plate 12 to fasten it to a vertical surface as will be described hereinafter. A web 16 slopes upwardly from the lower edge of the plate 12. The web includes a narrow flange 18 along the upper edge thereof, the flange 18 having an elongate recess 20 in the underside thereof. The recess 20 forms an elongate socket which extends along the free edge of the web and in the surface thereof which faces away from the plate 12.

Figure 2:
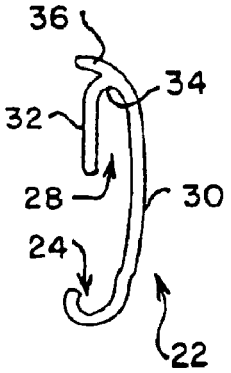
Figure 6:
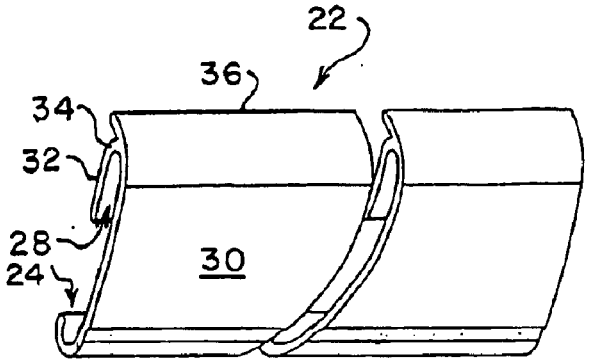

The face retaining extrusion 22 of FIGS. 2 and 6 is very generally C-shaped in section. The lower part of the extrusion 22 defines a shallow, upwardly open elongate socket 24 and the upper part of the extrusion 22 defines a downwardly open elongate recess 28. The recess 28 is bounded by part of the C-shaped outer wall 30 of the extrusion 22, by an inner wall 32 which lies generally parallel to and spaced from the wall 30, and by a return bend 34 which joins the upper ends of the walls 30 and 32. A display panel tensioning plate 36 protrudes from the outer face of the return bend 34 and extends the full length of the extrusion. The free edge of the plate 36, in use, bears on the display panel. The socket 24 and the parts of the extrusion 22 which bound the socket 24 form a hook structure.

Figure 3:
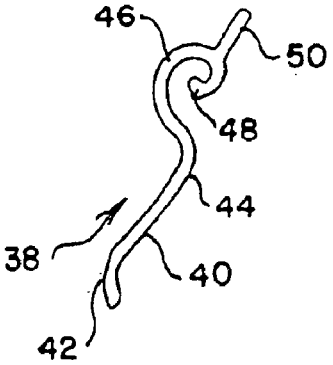
Figure 7:
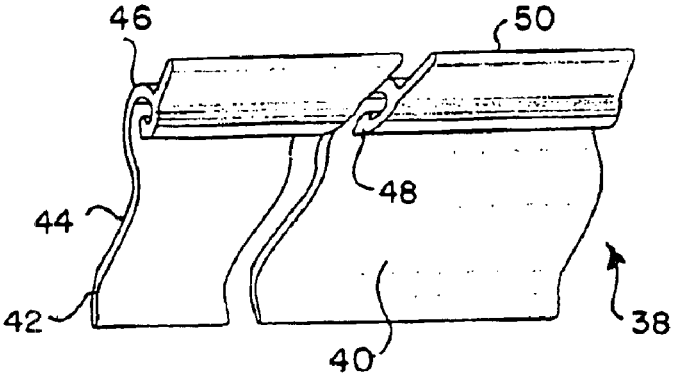

The locking extrusion 38 of FIGS. 3 and 7 comprises a main flap 40 which has two bends 42 and 44 therein. The part of the extrusion between the bend 42 and one free edge of the extrusion 38 constitutes a manually grippable locking and unlocking portion. The extrusion 38 further includes a part circular return bend 46 which terminates in an enlarged bead 48. The bend 46 and bead 48 constitute a hook structure. A pivot plate 50 protrudes outwardly from the return bend 46. The edge of the plate 50 remote from the hook structure constitutes a pivot edge.

Figure 4:
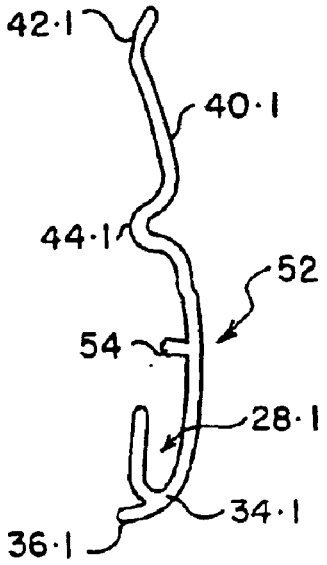
Figure 8:
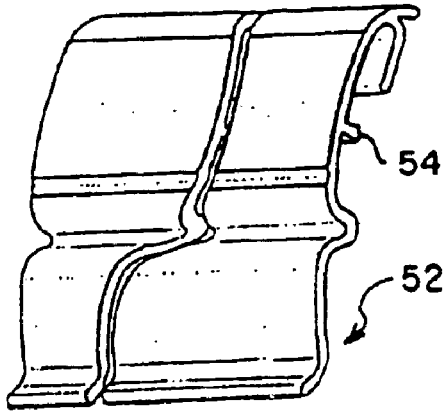

The extrusion 52 of FIGS. 4 and 8 is in essence a combination of the extrusions 22 and 38. Where applicable, therefore, like references have been used with the addition of the suffix 1.

A rib 54 is provided which extends along the full length of the extrusion 52.

All the extrusions are preferably of aluminium although a sufficiently rigid synthetic plastics material can be used.

Figure 13:
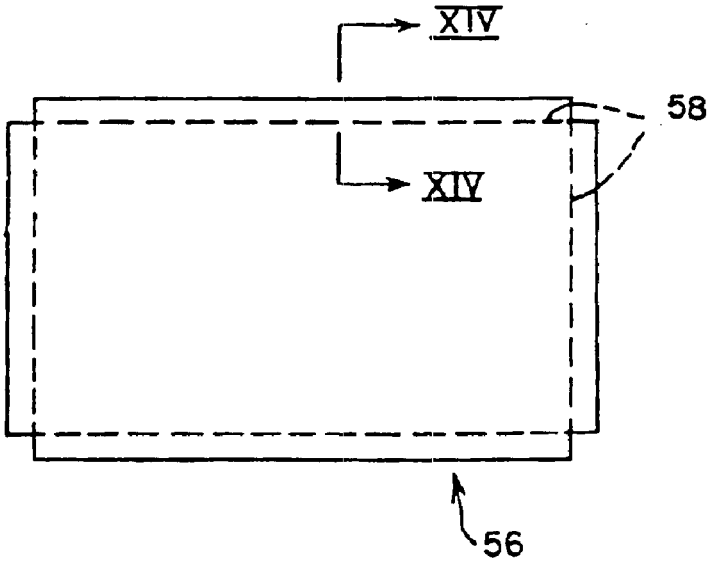
FIG. 13 is an elevation of a flexible display panel.
Figure 14:
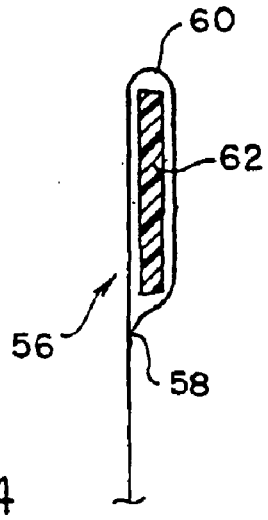
FIG. 14 is a section on the line XIV—XIV of FIG. 13.

The display panel 56 (see FIGS. 13 and 14) on which the advertisement is carried has all four of its edge portions turned-over and welded or sewn at 58 to the adjacent parts of the panel thereby to form elongate pockets 60. Stiffening strips 62 of plastics material or aluminum are inserted into the pockets 60 and run the full lengths of the pockets. The display panel 56 will normally be printed vinyl sheet.

Figure 10:
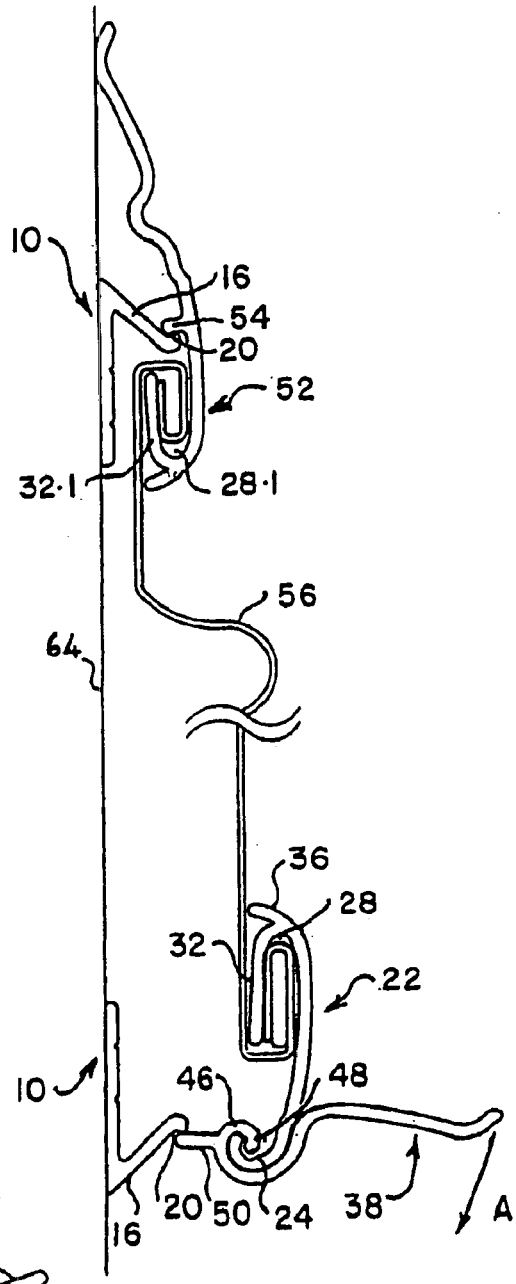
FIG. 10 is an end view of the mounting system in the condition shown in FIG. 9 and also shows the vertical surface to which the system is fitted.
Figure 12:
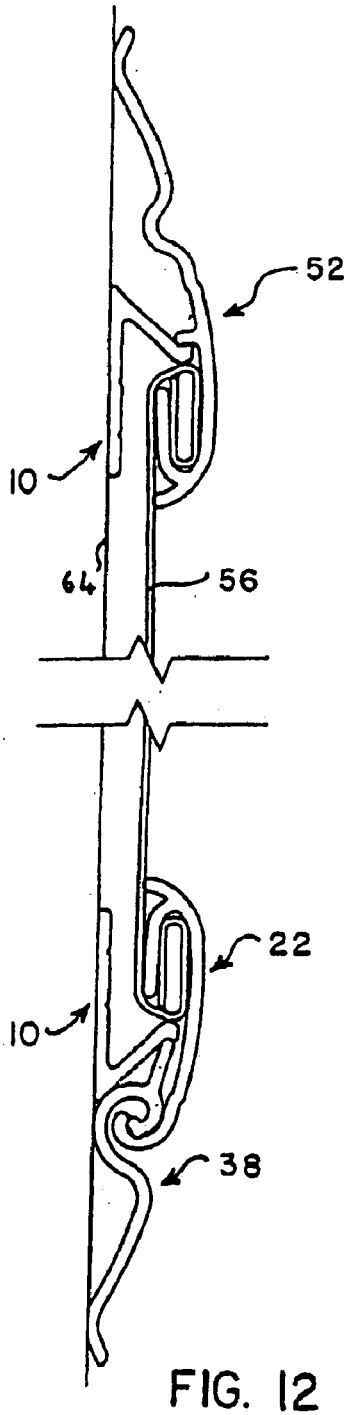
FIG. 12 is an end view of the mounting system in its locked condition.

A vehicle body side or other surface to which the display panel 56 is to be secured is shown at 64 in FIGS. 10 and 12.

Two lengths of the extrusion 10 are secured parallel to one another along the top and bottom edges of the surface 64 with the web 16 of the upper extrusion 10 sloping downwardly and the web 16 of the upper extrusion 10 sloping upwardly. This is illustrated in FIGS. 9 to 12. The fasteners which secure the extrusions 10 to the surface 64 have not been shown.

The recess 28.1 of the extrusion 52 is upwardly open and the pocket along the upper edge of the face 56 is inserted into it through its open upper end. The display panel 56 bends around the free edge of the wall 32.1 and extends downwardly adjacent the outer face of the wall 32.1.

The lower pocket is similarly inserted into the downwardly open lower recess 28 from below and the hook structures of the extrusions 22 and 38 inter-engaged by sliding the end part of the bend 46 and the bead 48 into the socket 24. The rib 54 is then placed in the upwardly open socket 20 of the upper extrusion 10 so that the display panel 56 and the extrusions 22, 38 hang from the upper extrusion 10.

Figure 9:
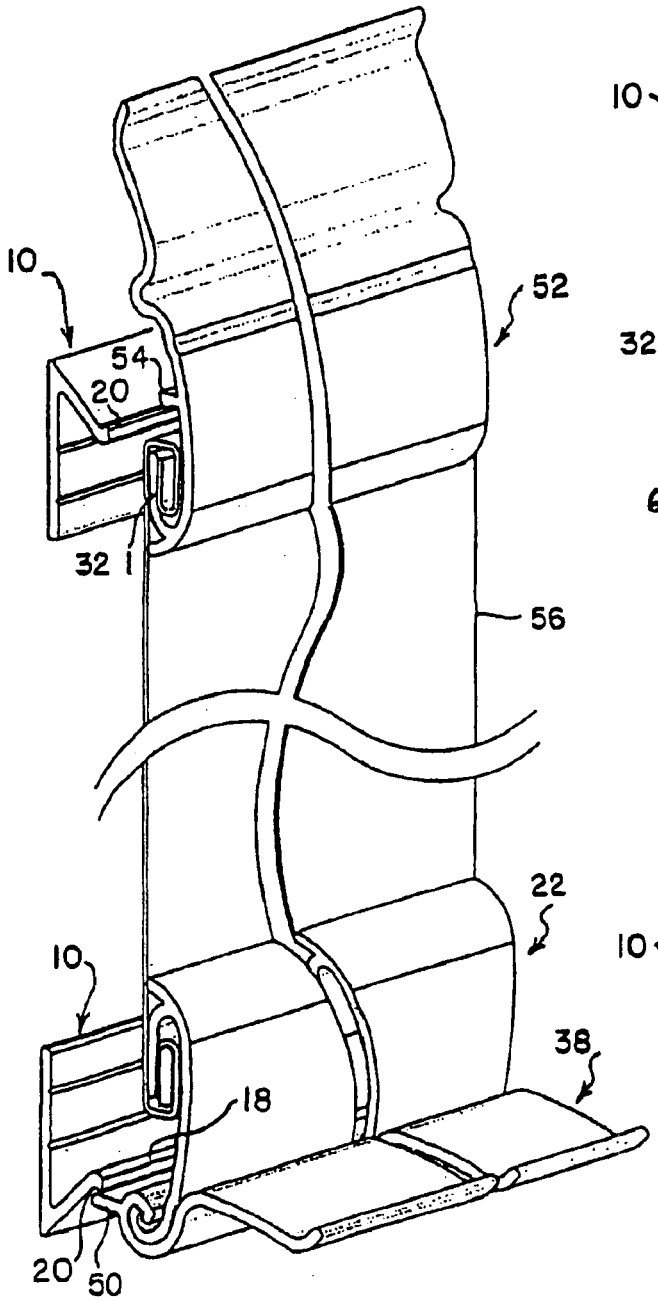
FIG. 9 is a pictorial view of a mounting system prior to it reaching its locked condition.

The pivot plate 50 of the extrusion 38 is then inserted under the flange 18 and into the recess 20 as seen in FIGS. 9 and 10. The locking portion at the free end of the extrusion 38 is then swung in downward arc, as indicated by arrow A in FIG. 10. The lower extrusion 22 is thus pulled downwardly and inwardly towards the surface 64. As the extrusion 38 moves past its bottom dead centre position it snaps towards the surface 64.

The free edges of the tensioning plates 36 and 36.1 bear on the face 56 where it emerges from behind the upper and lower mountings and assist in tensioning the panel. The lower plate 36 also prevents dirt, leaves and other debris collecting between the face 56 and the surface 64.

Figure 11:
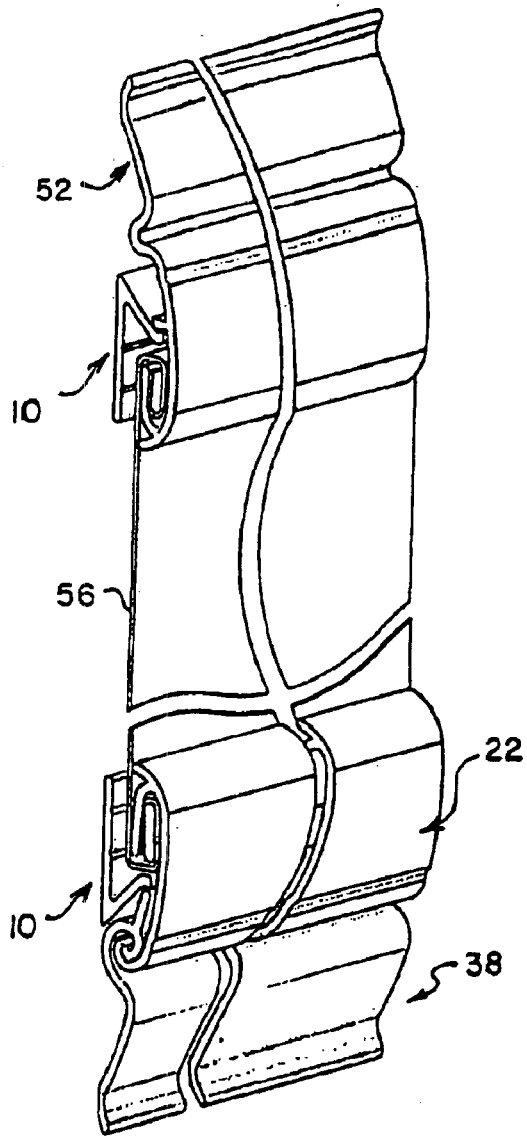
FIG. 11 is a pictorial view showing the mounting system in its locked condition.
Figure 15:
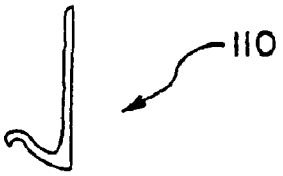
FIGS. 15, 16, 17 and 18 are sections through four extrusions which together constitute a further display panel mounting system.
Figure 19:
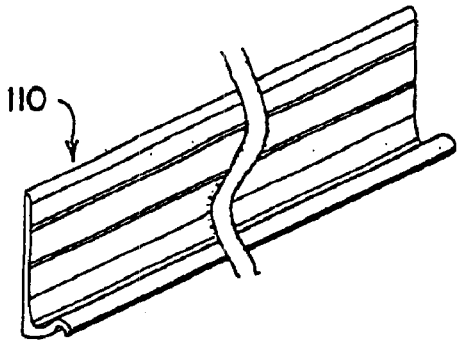
FIGS. 19, 20, 21 and 22 are pictorial views of the extrusions of FIGS. 15 to 18.
Figure 16:
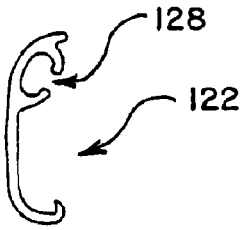
Figure 20:
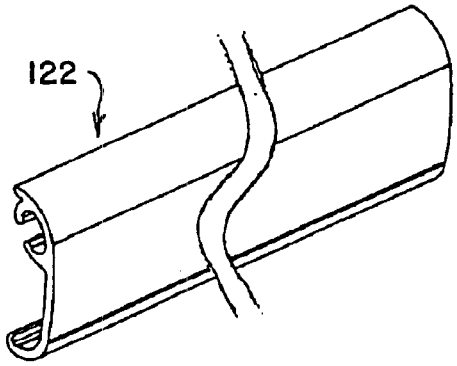
Figure 17:
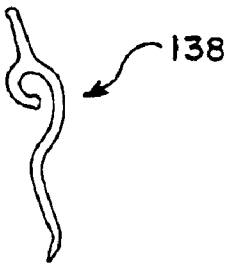
Figure 21:
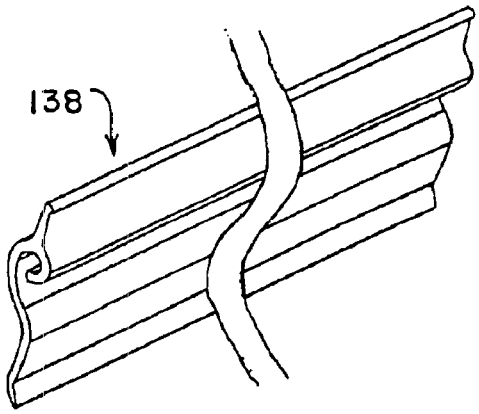
Figure 18:
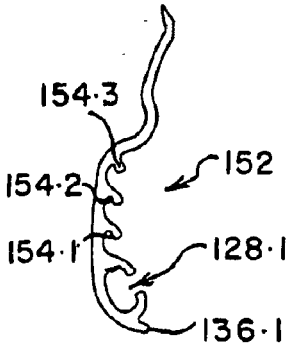
Figure 22:
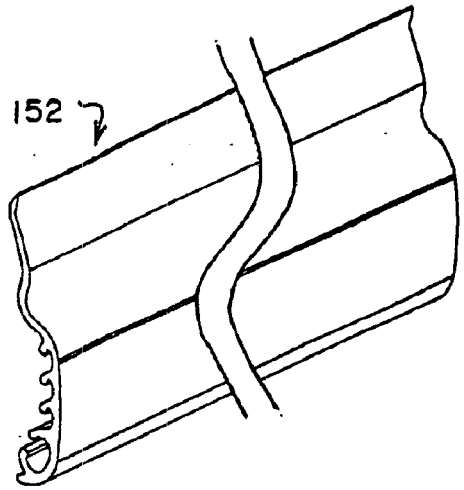

As best seen in FIG. 11, the appearance of the upper mounting is substantially the same as that of the lower mounting despite the fact that a different number of extrusions are employed.

The vertically extending edges of the display panel can be secured in place in the same way as the horizontally extending edges. More specifically, further extrusions 10 are mounted on the surface 64, these extrusions 10 extending vertically and being horizontally spaced. An extrusion 52 is used in conjunction with one vertically extending extrusion 10 and extrusions 22 and 38 in conjunction with the other vertically extending extrusion 10. The upper and lower horizontally extending mountings will normally be locked as described above before the mountings along the vertical edges of the display panel. All four edges will normally be secured where the surface 64 is on a moving vehicle but two edges can an be left free if the surface 64 is stationary. For aesthetic reasons, however, it is desirable to secure all four edges of the display panel 56.

Referring now to FIGS. 15 to 22, these illustrate the four extrusions which constitute a further mounting system. The extrusions of FIGS. 15 to 22 have many features in common with the extrusions of FIGS. 1 to 8. As a consequence, where applicable, like parts have been designated with like reference numerals preceded by the prefix 1.

The recess 128 of the extrusion 122 is, for the reason which will be described hereinafter, of a different configuration to the recess 28.

The extrusion 152 differs somewhat in configuration from the extrusion 52. The single rib 54 is replaced by a series of ribs 154.1, 154.2 and 154.3. This enables the extrusion 152 to be interengaged with the upper extrusion 110 in three different positions instead of in a single position.

The recess 128.1 differs in configuration to the recess 28.1 for the same reason that the recesses 28 and 128 differ from one another.

Figure 23:
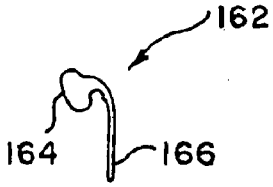
FIGS. 23 and 24 are a section through and a pictorial view of an extrusion lengths of which are secured to two or more edges of the display panel.
Figure 24:
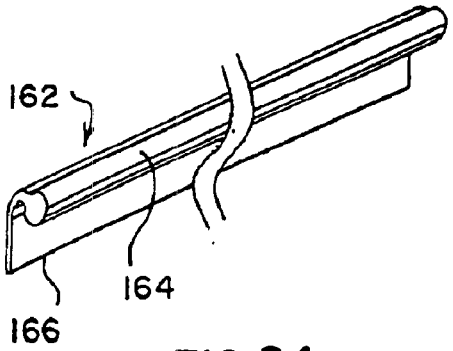
Figure 25:
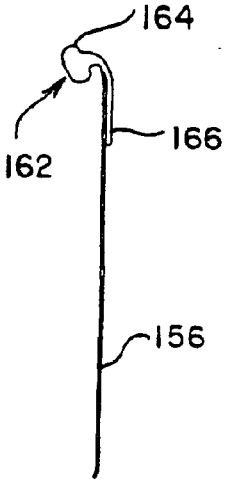
FIG. 25 is an end view of a display panel which has lengths of the extrusion shown in FIGS. 23 and 24 secured thereto.
Figure 26:
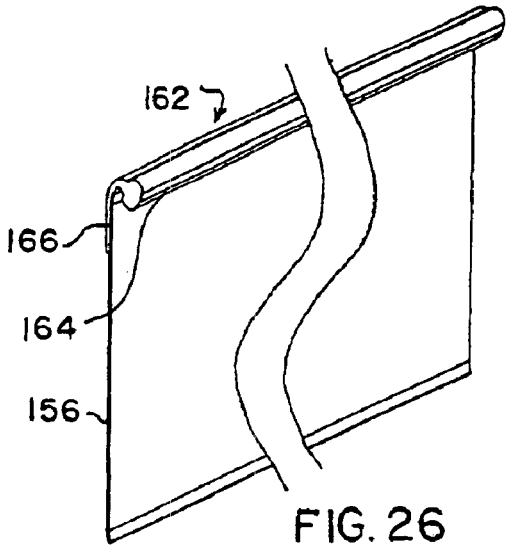
FIG. 26 is a pictorial view of the panel and extrusions of FIG. 25.
Figure 27:
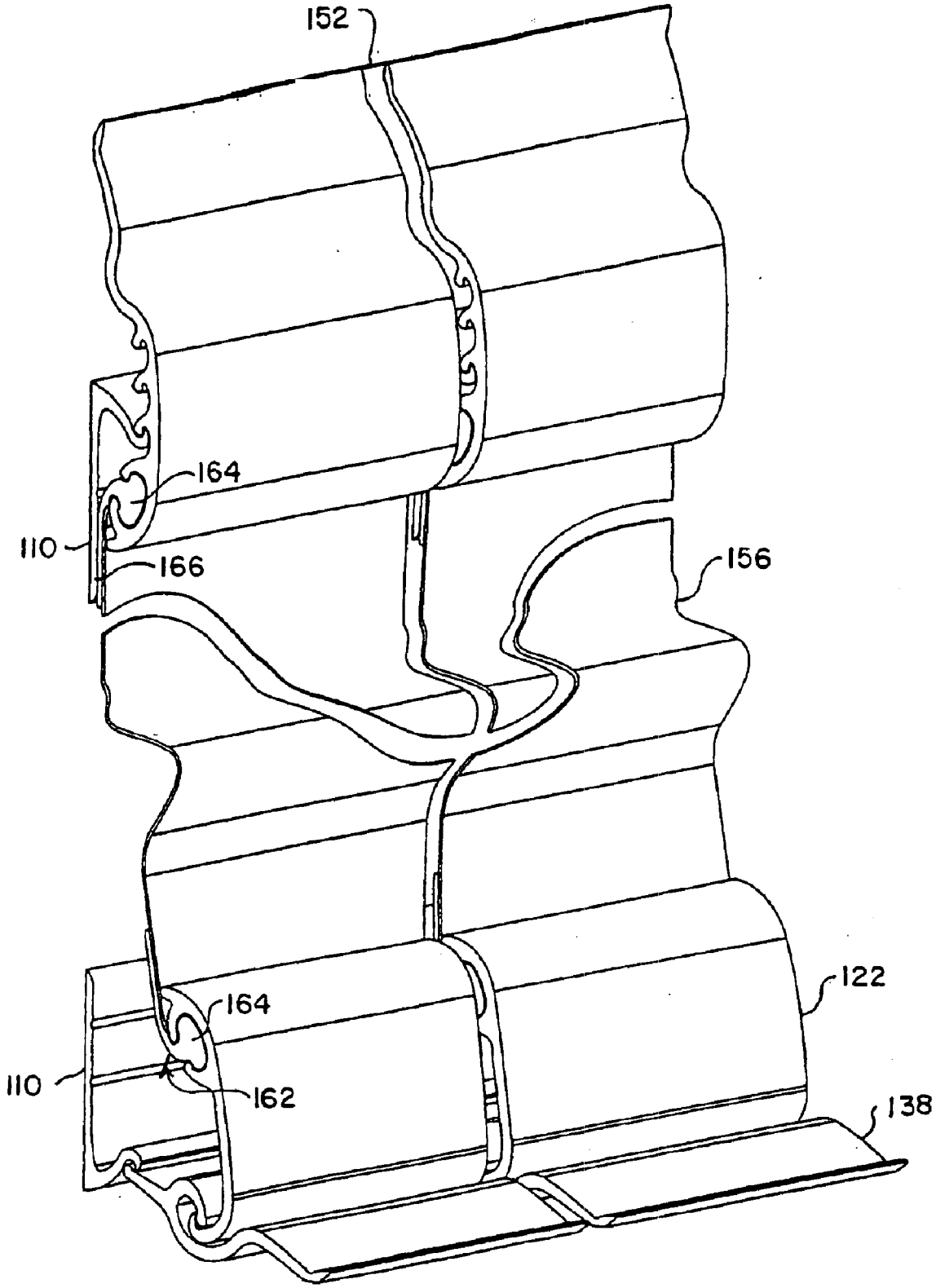
FIG. 27 is a pictorial view of the further mounting system prior to it reaching its locked condition.
Figure 28:
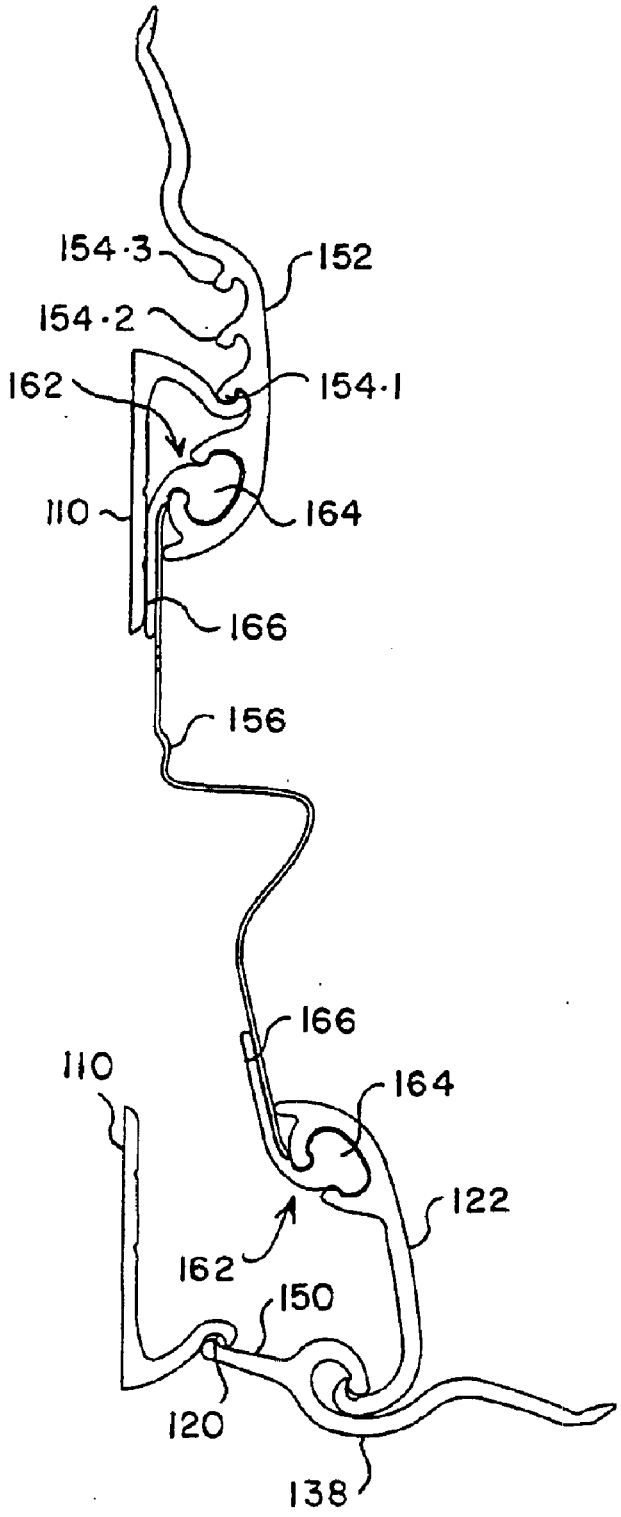
FIG. 28 is an end view of the further mounting system in the condition shown in FIG. 27 and also shows the vertical surface to which the system is fitted.
Figure 29:
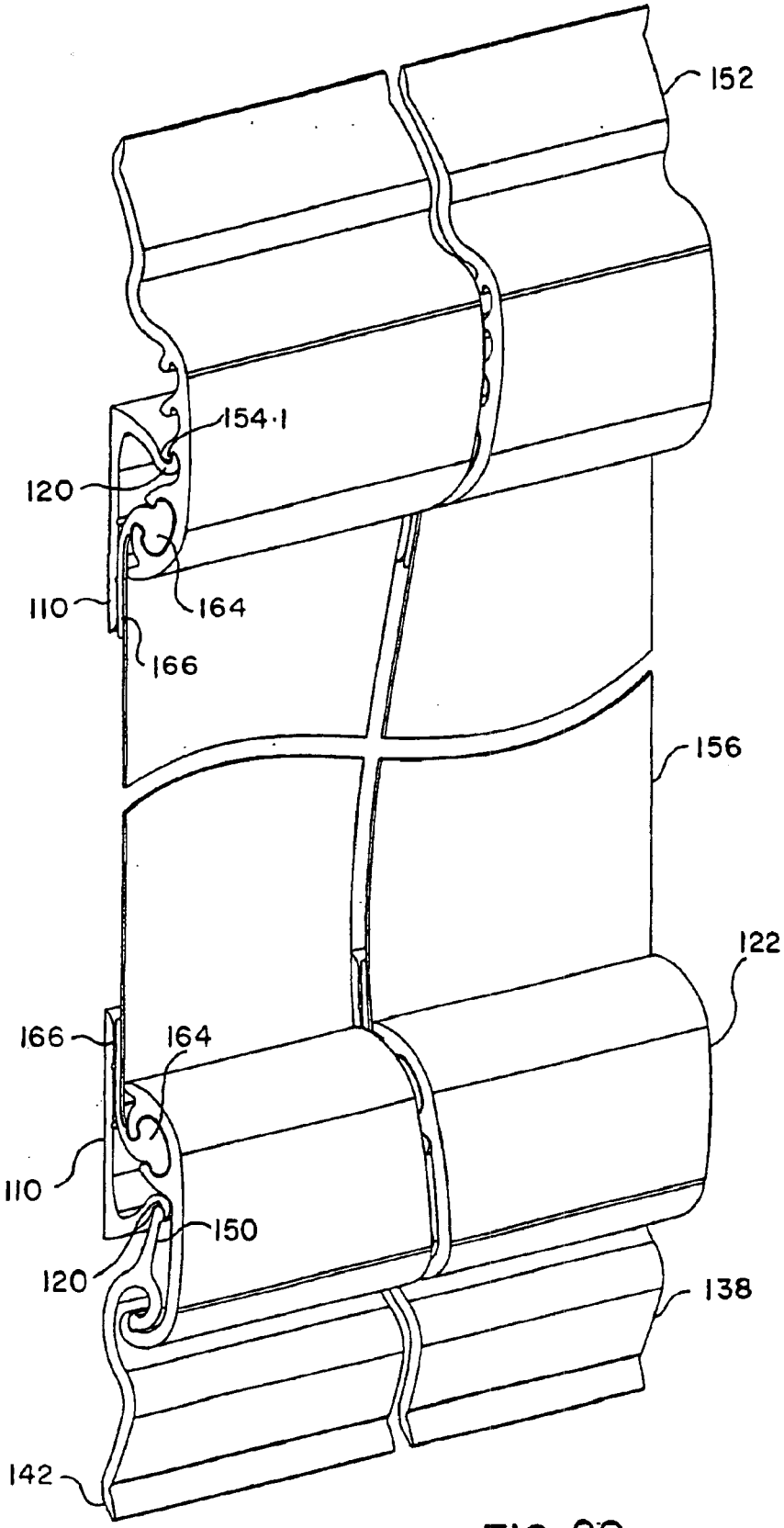
FIG. 29 is a pictorial view showing the further mounting system in its locked condition.
Figure 30:
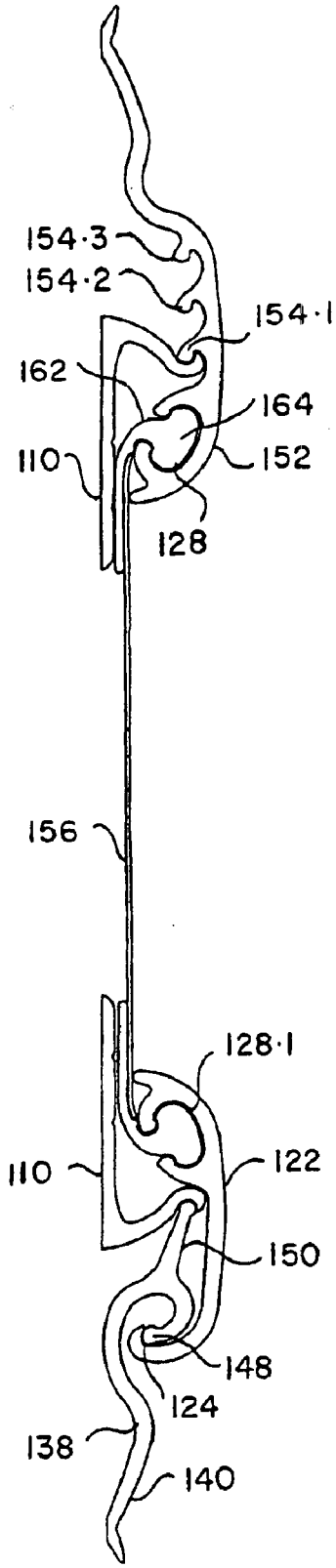
FIG. 30 is an end view of the further mounting system in its locked condition.

The extrusion 162 of FIGS. 23 and 24 is of a synthetic plastics material, or a rubber compound, which will weld to the panel 156 (FIGS. 25 and 26). It comprises a bead 164 the shape of which matches that of the recesses 128, 128.1. It also comprises a strip-like portion 166 which is thin in section, as compared to the bead 164, and it is these portions which are welded along the edges of the panel 156 (see particularly FIGS. 25 and 26).

The panel 156 is mounted on the upper and lower extrusions 152 and 122 by feeding the beads 164 of the extrusions 162 which are welded to the upper and lower edges of the panel through the recesses 128 and 128.1 from the ends of the recesses. An appropriate one of the ribs 154.1, 154.2 and 154.3 is engaged with the recess 120 of the upper extrusion 110. Thereafter the procedure for mounting the panel 156 is the same as the procedure for mounting the panel 56.

The procedure followed to remove the panel 156 is the same as that followed to remove the panel 56 except in that the beads 164 cannot simply be lifted from the recess 128 and 128.1 but must be withdrawn by sliding them along the recesses.

What is claimed is:

1. A mounting structure for a display panel which comprises first and second mounting elements secured to a surface wherein each of said mounting elements comprises a plate which is fastened to said surface, and an inclined web protruding from said plate, there being a recess along a free edge of each web and in that surface thereof which faces away from the plate, the elements being parallel to one another and spaced apart, and the second element having a pivot surface extending along it, a third mounting element including means for releasably attaching an edge of the display panel thereto and which itself serves, in use, releasably to connect the display panel to said first mounting element, a fourth mounting element including means for releasably attaching an opposed edge of the display panel thereto, and a locking element including means for pivotally connecting it to said fourth mounting element and having a pivot edge about which it can be swung in an arc with respect to the said pivot surface of said second element from an unlocked position through a dead centre position into an over centre position in which it secures said fourth mounting element with respect to said second mounting element.

2. A mounting structure as claimed in claim 1, wherein said locking element comprises a hook structure for connecting it to said fourth mounting element and, a plate extending away from said hook structure, said pivot edge being constituted by the edge of said plate remote from the hook structure.

3. A mounting structure as claimed in claim 2, wherein said third element and said fourth element both include plates which have elongate edges that in use bear on the display panel.

4. A mounting structure as claimed in claim 5, wherein said fourth mounting element includes a hook structure which can be inter-engaged with the hook structure of the locking element.

5. A mounting structure as claimed in claim 4, wherein said third element and said fourth element both include plates which have elongate edges that in use bear on the display panel.

6. A mounting structure as claimed in claim 1, wherein said third element and said fourth element both include plates which have elongate edges that in use bear on the display panel.

* * * * *